United States Patent [19]

Cornelio

[11] Patent Number: 4,492,239

[45] Date of Patent: Jan. 8, 1985

[54] SMOKING BLEND EFFECTIVE TO DISCOURAGE THE BAD HABIT OF SMOKING AND CIGARETTES OR THE LIKE OBTAINED THEREBY

[76] Inventor: Francesco Cornelio, Via Roma, 13, 33030 - Varmo (Udine), Italy

[21] Appl. No.: 463,067

[22] Filed: Feb. 1, 1983

[30] Foreign Application Priority Data

Oct. 2, 1982 [IT] Italy ..... 84107 A/82

[51] Int. Cl.[3] ..... A24D 1/00; A24B 15/30

[52] U.S. Cl. ..... 131/270; 131/352

[58] Field of Search ..... 131/270, 309, 310, 364, 131/365, 352

[56] References Cited

U.S. PATENT DOCUMENTS 3,439,685 4/1969 Allen ..... 131/270

*Primary Examiner*—Vincent Millin

*Attorney, Agent, or Firm*—Bucknam and Archer

[57] ABSTRACT

The smoking blend comprises tobacco or a tobacco substitute material and a chemical substance which is formaldehyde (formol or formalin), absorbed on the tobacco or a tobacco substitute, or paraformaldehyde, having the formula $(HCHO)_n$, in which n is equal to or greater than 3.

15 Claims, 6 Drawing Figures

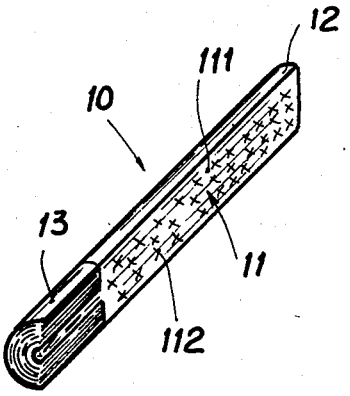
Fig. 1
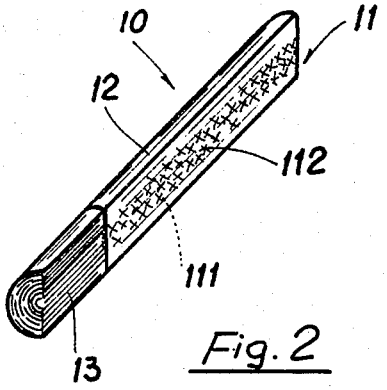
Fig. 2
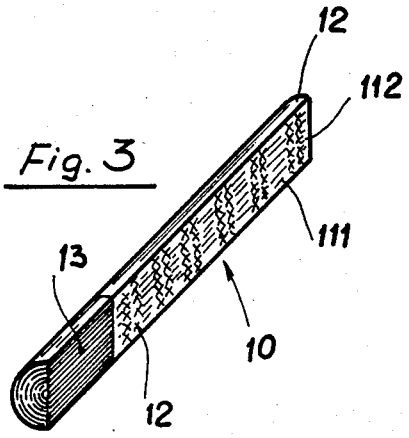
Fig. 3
Fig. 4
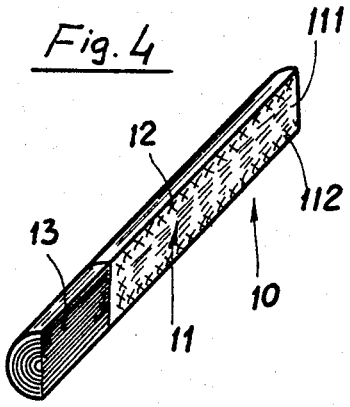
Fig. 5
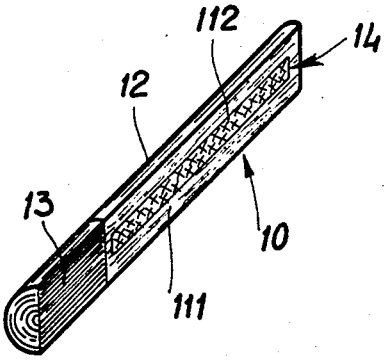
Fig. 6
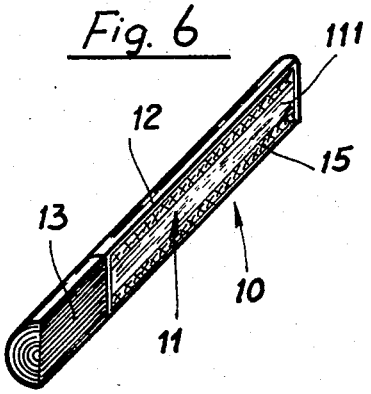

SMOKING BLEND EFFECTIVE TO DISCOURAGE THE BAD HABIT OF SMOKING AND CIGARETTES OR THE LIKE OBTAINED THEREBY

The present invention relates to a product capable of discouraging the bad habit of smoking.

More specifically, it relates to a smoking blend comprising tobacco or a tobacco substitute and an antismoking chemical substance, suitable for cigarettes and the like.

The invention also relates to cigarettes and the like capable of discouraging the bad habit of smoking and comprising the blend.

According to the invention, the chemical substance, in powder, granulated form or in solution is capable of providing, by sublimation during the combustion of the cigarette or the like, a gaseous product acting on the main respiratory organs in such a way as to cause in the smoker an annoying, though not dangerous, feeling as well as advantageous antiseptic and soothing effects.

These feelings after being transmitted to the brain of the smoker and being stored there, are truly effective to permanently discourage the bad habit of smoking.

Several means and methods are already known for discouraging the bad habit of smoking, which are generally based on the principle of aversion to tobacco.

In fact, in addition to hypnosis, needle-puncturing, mesotherapy consisting of injecting at the needle-puncturing points small doses of therapeutical substances, several method are known for causing aversion to smoke.

To this end, have been used, for example, silver salts such as silver nitrate and proteinate, in diluted solutions, provided for gargling before smoking.

By this method the cigarette smoke becomes disgusting, so that the smoker is compelled to extinguish the cigarette.

On the other hand, these substances are rather dangerous to health, because of their toxicity. Moreover, they are efficient only for a reduced time.

Another method consists of orally administering lobeline.

As it is known, lobeline is an alkaloid having a similar structure to nicotine and accordingly it acts as an antagonist of nicotine, so as to provide a feeling of satisfaction with respect to tobacco smoke.

However, also this method has not been successful in providing satisfactory results.

Yet other methods for discouraging the deleterious effects of tobacco smoking consist of making less dangerous cigarettes, by using tobacco blends of poor nicotine contents as well as special filters consisting, for example, of denicotinized tobacco leaves and accordingly capable of absorbing a great amount of nicotine.

Also the latter known means and methods, however, have not been able to provide satisfactory results, since their action is of a comparatively short duration and not completely safe. Moreover, those methods and means cause side effects of withdrawal.

Accordingly, one object of the present invention is to overcome the drawbacks of the known methods and means presently used for discouraging the bad habit of smoking.

A primary object of the present invention is to afford the possibility of quickly suppressing the smoking bad habit during the smoking itself.

According to one aspect of the present invention the above mentioned objects and other objects, which will become more apparent hereinbelow, are achieved by a smoking blend capable of discouraging the bad habit of smoking which comprises tobacco or a tobacco substitute and a chemical antismoking substance which is capable of providing by sublimation, due to the heat from the cigarette, during smoking, a gaseous product capable of locally acting on the main respiratory organs in such a way as to discourage the bad habit of smoking, the antismoking substance consisting of solid paraformaldehyde, having the formula $(HCHO)_n$, wherein n is equal to or greater than 3, said substance being either optionally mixed with carrier or excipient materials.

According to another aspect of the invention, the above objects are also achieved by a cigarette or the like effective to discourage the bad habit of smoking and prepared with the blend of this invention, comprising tobacco or a tobacco substitute and a chemical antismoking substance consisting of a solution of formaldehyde (formol or formalin), having the formula HCHO, adsorbed on the tobacco or the tobacco substitute or solid paraformaldehyde having the formula $(HCHO)_n$, wherein n is equal to or greater than 3.

More specifically, the antismoking method and blend according to the present invention are capable of providing the brain of the smoker with annoying feelings, thus discouraging the smoker from smoking.

In addition, the inventive antismoking method is of a direct type, since the smoker is compelled to stop smoking by smoking.

Moreover, it does not cause any symptoms of withdrawal and leaves the smoker quiet and tranquil as he/she had never smoked.

Another advantage of the present invention is that it does not cause any deleterious side effects.

Yet another advantage of the invention is that it provides antiseptic and soothing effects.

The method according to the invention induces a conditioned reflex capable of inhibiting the smoker from continuing smoking.

The blend according to the invention, in fact, is such as to provide a disagreeable stimulus repeating in the time and truly inhibiting the smoker from smoking.

In fact, by smoking, at time intervals, for 8–10 times, the blend according to the invention, an antagonist conditioned effect is established in the smoker, which compels the latter to reject the cigarette.

For the purpose of manufacturing the cigarettes or the like, the antismoking substance according to the invention, in the form of a solution (formalin or formol) may be mixed with other suitable carrier or excipient materials such as talc, menthol, and the like, so that the substance is obtained in the solid form, so that it may be prepared in the form of powder, granulated material or solid plugs.

It has been found that the concentration of formaldehyde or paraformaldehyde in the smoking blend is not critical and may vary from 5 to 50% by by weight, based on the tobacco or tobacco substitute material.

A concentration of 26% by weight is preferred, since that amount has provided optimal results.

In order to understand more completely the present invention, a preferred embodiment thereof in the form of a cigarette will be thereinafter illustrated in a more detailed way, with reference to the accompanying drawing, in which:

FIGS. 1 to 6 illustrate cross-sectional views of antismoking cigarettes, made in a known way, and including the tobacco or the like antismoking blend according to the present invention.

With reference to FIG. 1, the cigarette 10, which may be made by any suitable know methods, consists of a blend 11, according to the present invention, wrapped in a cigarette paper 12.

At one end, the cigarette is provided with a conventional filter 13.

It should be noted that the provision of the filter 13 is an optional choice, and it may be omitted.

As it is shown in FIG. 1, the blend 11 comprises tobacco or a tobacco substitute, indicated at 111, and an antismoking substance or composition 112, in powder or granulated form, which substance is blended with the tobacco or tobacco substitute.

According to the invention, the antismoking substance consists of solid paraformaldehyde, having the formula $(HCHO)_n$, or of formaldehyde solution (formol or formalin), absorbed on the tobacco or tobacco substitute, or mixed and obtained in the solid form by means of carrier or excipient materials.

The antismoking substance or composition is capable of providing by sublimation due to heating during smoking, gaseous formaldehyde, which acts on the mucous tissue of the main respiratory organs, by causing itch and disgust effects, which are not dangerous to the health, as well as advantageous antiseptic and soothing effects.

As it is shown in FIG. 2, the antismoking substance 112 is arranged in the center zone of the cigarette, according to a longitudinal arrangement.

FIG. 3 illustrates a variation according to which the antismoking substance 112 is located in the cigarette 10 through transversal layers distributed along the length of the cigarette itself.

FIG. 4 illustrates another variation of the antismoking cigarette 10 in which the antismoking substance 112 is arranged outside of the tobacco or tobacco substitute material 111, near the cigarette paper 12, optionally in contact with the latter.

It should be noted that the antismoking substance may be contained in an envelope or package 14 (see FIG. 5) or 15 (FIG. 6) so that it may be introduced into the cigarette during or after the manufacture.

More specifically, the envelope 14 or 15 is made of paper or other suitable combustible materials so that it may be gradually consumed during the combustion of the cigarette.

The envelopes 14 or 15 may be arranged in the center of the cigarette 10 (FIG. 5) or peripherically with respect to the tobacco or tobacco substitute, as it is shown in FIG. 6.

Thus a smoker may introduce the antismoking substance containing envelope or casing in the selected cigarette, to obtain quickly the antismoking effects of the blend according to the present invention.

The invention as disclosed is susceptible to many modifications and variations falling within the scope thereof.

By way of example, the antismoking blend according to the present invention may be smoked in pipes or water pipes (hookahs) or similar smoking means.

In addition, it will be possible to prepare the antismoking substance or composition in the form of a powder, granulated material or the like, in a loose condition or in combustible cases or in the form of solid plugs, suitable for being longitudinally introduced into the cigarettes during or after the manufacture, without departing from the spirit and scope of the present invention, as defined in the accompanying claims.

I claim:

1. A smoking blend capable of discouraging the habit of smoking, which comprises tobacco or a tobacco substitute and an antismoking chemical substance which is solid paraformaldehyde of formula $(HCHO)_n$, wherein n is equal to or greater than 3 or formalin.

2. A smoking blend according to claim 1 wherein said antismoking substance is adsorbed on the tobacco or tobacco substitue.

3. A smoking blend according to claim 1, wherein said antismoking substance is mixed with at least one carrier or excipient.

4. A smoking blend according to claim 1, wherein said antismoking substance is present in said blend in an amount of 5–50% by weight, based on the weight of tobacco or said tobacco substitute.

5. A smoking blend according to claim 4, wherein the amount of said antismoking substance present in said blend is 26%.

6. A cigarette capable of discouraging the habit of smoking, which comprises a smoking blend according to claim 1.

7. A cigarette according to claim 7, wherein said antismoking substance is longitudinally arranged in the center of said cigarette.

8. A cigarette according to claim 6, wherein said cigarette comprises an enclosure made of paper or other combustible material, arranged longitudinally in the center thereof and said antismoking substance is contained in said enclosure.

9. A cigarette according to claim 6 wherein said antismoking substance is transversely arranged in parallel superimposed layers within said cigarette.

10. A cigarette according to claim 6, wherein said cigarette has a paper wrapping and said antismoking substance is peripherically located in a longitudinal layer included between the wrapping paper and said tobacco or tobacco substitute.

11. A cigarette according to claim 6, wherein said antismoking substance is packaged in an envelope made of paper or other combustible material, arranged in the center of said cigarette or peripherically with respect to the tobacco or tobacco substitute.

12. The blend according to claim 1, wherein said antismoking substance is present in a granulated form.

13. The blend according to claim 1, wherein said antismoking substance is present in powder form.

14. The blend according to claim 1, wherein said antismoking substance is present partially in the form of a powder and partially in the form of a granulated material.

15. An envelope of paper or other combustible material containing paraformaldehyde or formalin.

* * * * *